United States Patent [19]

Barlow et al.

[11] 4,211,412

[45] Jul. 8, 1980

[54] FIGHTING U.F.O'S

[75] Inventors: Gordon A. Barlow, Skokie; Anthony T. Janiszewski, Elmwood Park, both of Ill.

[73] Assignee: Gordon Barlow Design, Skokie, Ill.

[21] Appl. No.: 938,809

[22] Filed: Sep. 1, 1978

[51] Int. Cl.[2] ..... A63B 67/00; A63F 9/00

[52] U.S. Cl. ..... 273/424; 46/82; 273/356

[58] Field of Search ..... 273/95 G, 95 C, 119 B, 273/129 F, 101, 106 F, 119 B, 129 F; 46/44, 74 D, 82

[56] References Cited

U.S. PATENT DOCUMENTS

| | | | |
|---|---|---|---|
| 1,850,715 | 3/1932 | Gottfried | 273/95 C |
| 2,055,498 | 9/1936 | Jacobs | 273/95 C |
| 3,465,471 | 9/1969 | Friedman | 46/44 |

*Primary Examiner*—Charles E. Phillips
*Attorney, Agent, or Firm*—Alter and Weiss

[57] ABSTRACT

A table top game unit wherein two opposing players direct air streams to each control their own unidentified flying objects (U.F.O.'s) in the form of flying saucers to cause them to collide against each other until the opposing U.F.O.'s are ejected from the game area.

10 Claims, 8 Drawing Figures

FIGHTING U.F.O'S

This invention is concerned with game devices; and more particularly, with game devices using air streams for controlling individual, unique flying saucers.

Games of combat between warring vehicles or aircraft have always enjoyed a great deal of popularity. Such games of combat have, in the past, relied largely on chance rendered by the throwing of dice or the spinning of an arrowed indicator. The popularity of such games have increased when there has also been some element of skill involved in the game.

Generally, the more popular games have also involved mobile vehicles or aircraft and the requirement to use skill in manipulating the mobile craft. therefore, it is an object of the present invention to provide a new and entertaining combat game which combines mobile aircraft and requires skill in manipulating and moving the aircraft in competition with other players.

A related object of the present invention is to provide competitive combat games wherein each of the players manipulate a moving flying saucer-like device and wherein the flying saucerlike devices actually are manipulated to collide with each other until one of the players' colliding flying saucers are forced past the periphery wherein the air stream maintains flight; and thus, the flying saucers fall and are effectively "shot down".

Still another object of the present invention is to provide a plurality of flying saucers for each of combatants in the inventive game so that the loss by one player of a single or a plurality of flying saucers does not necessarily mean that player is eliminated from the game.

Yet another related object of the present invention is to provide a unique air stream manipulating tube for controlling flying saucers.

Still another object of the present invention is to use a single air compressor for providing an air stream for both of the combatants utilizing the inventive game.

Yet another object of the present invention is to provide unique flying saucers which can be controlled by the air stream in the environment of the game.

Another object of the present invention is to provide individual sections of the game which are easily clamped together for assembling the complete game, thus enabling the game to be shipped or stored in a knocked down condition.

In one preferred embodiment of the present invention a base unit is provided containing an air compressor. Also in the base unit are the batteries for operating the motor driven air compressor.

The air compressor is preferrably centrally located in the base under a domed unit. Central to the dome are the motorized vanes which direct air into a pair of spaced apart vertical parallel tubes normally perpendicular to the base unit. A pair of side walls hold a plastic roof over the base unit. The roof contains means for storing a plurality of flying saucers in the rest position; i.e., when they are not being motivated by a stream of air.

The flying saucers are uniquely shaped so that air is directed at the flying saucers causing them to rotate. They spin around a pyramidal projection abutting the roof. The air tubes are movable enabling aiming the air stream at the flying saucers and controlling the movement of the flying saucers around the roof. Each player forces his flying saucer to collide with the other players' flying saucer at opportune times until one or the other of the opposing flying saucers is forced out of the range of the air directed from the tube controlling that flying saucer so that the flying saucer crashes to the ground. The first participant to force down all the flying saucers of the other participant is the winner.

The above mentioned and other objects and features of the present invention together with the manner of obtaining them will be best understood by making reference to the accompanying drawings, wherein.

Figure 1:
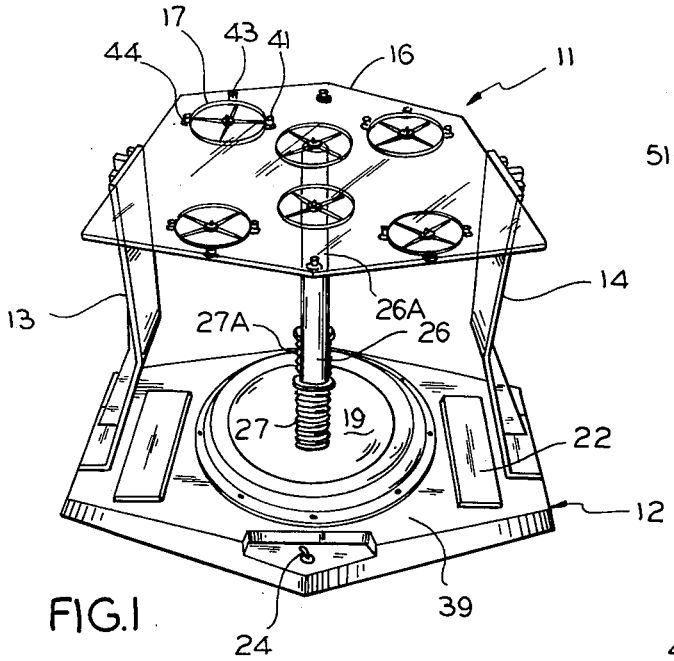
FIG. 1 is a pictorial view of the inventive fighting U.F.O. game unit.
Figure 3:
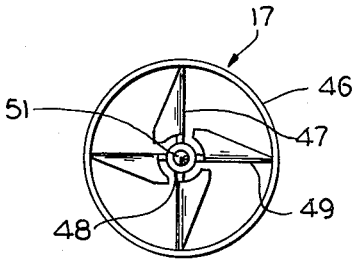
FIGS. 3 and 4 are plan views of opposing flying saucers.

The fighting U.F.O. game 11 includes a base unit 12 having a pair of oppositely disposed substantially vertical standards or walls 13 and 14. The walls support a transparent ceiling unit 16. The ceiling unit provides, among other things, means for parking U.F.O.'s or flying saucers, such as flying saucer 17. The ceiling unit also provides a surface on which the flying saucers rotate, when actuated by an airstream.

The base unit includes a centrally located dome 19 and compartments for storing batteries, such as compartments 21 and 22. A battery 23 is shown in the partial sectional view of compartment 21.

Means are provided for activating the power circuitry controlling the air compressor pump within the dome. More particularly, switch 24 couples the battery to the electrical motor driven air compressor pump located in the dome.

Means are provided for selectively directing the air stream toward particular ones of the flying saucers. More particularly, air tubes 26 and 26A are provided which can be moved around their base axle in any direction. Means, such as the accordian pleated sections 27, 27A enable such rotational manipulation of each of the air tubes.

Figure 6:
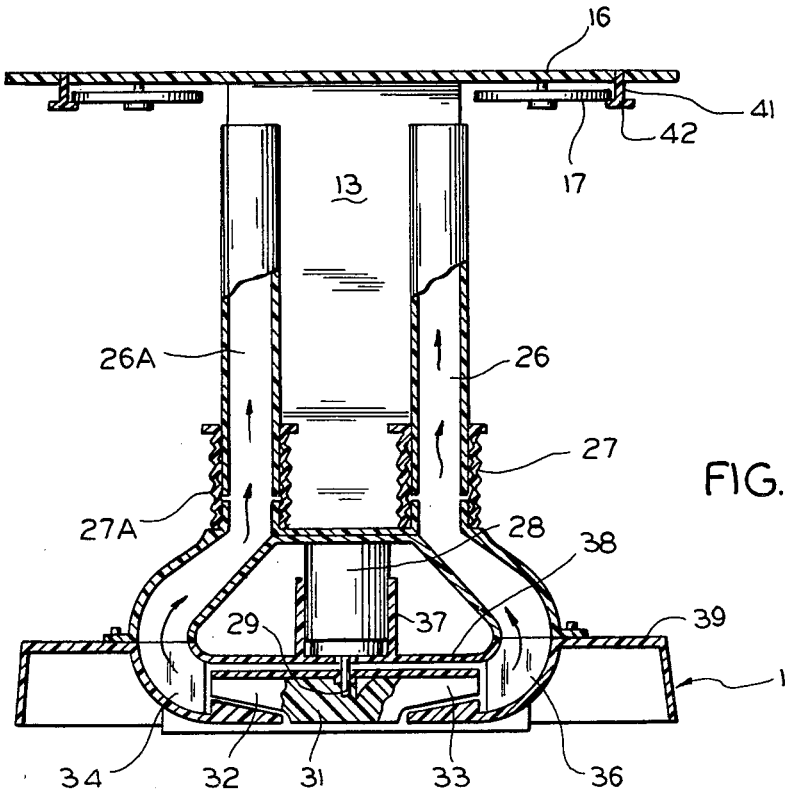
FIG. 6 is a sectional view taken along plane 6—6 in FIG. 5 and looking in the direction of the arrows.

As best seen in FIG. 6, the motor 28 is mounted by pressfitting it into the motor compartment defined by the upstanding cylindrical section 37. The shaft 29 of motor 28 extends through floor section 38 of the compressor and is attached to the compressor blades 31 in any manner well known to those skilled in the art. The blades 31 comprise a multiplicity of vanes, such as vanes 32 and 33.

The floor of the base 12 is shown as floor 39 in FIG. 6. Roof section 16 is shown attached to upstanding standard or wall support 13. Also, shown in FIG. 6 is the landing facilities for the flying saucers, such as U.F.O. 17. More particularly, there is shown press-fitted into the roof section 16 a plurality of large headed pegs, such as peg 41, having a head 42 which remains spaced apart from the roof 16. The landing pegs are triangularly spaced to best support the flying saucers when at rest. For example, U.F.O. 17 is shown at rest in FIG. 1 and supported on the three landing pegs 41, 43, 44. The spacing of the pegs enable moving the flying saucers away from the landed position responsive to a moving stream of air. The landing pegs are also positioned so that the flying saucers share intermediate ones of the landing pegs. Thus, for example, five landing pegs support two flying saucers.

It should be noted that the flying saucers each comprise a peripheral member 46 surrounding a plurality of blades, such as blade 47, extending from a hub section 48. The blades are angled downward from a horizontal rod 49 and the leading end of each of the blades is angled from the peripheral member to the hub section. The hub section 48 includes an upstanding pyramidal projection 51 which is designed to abut the roof 16, when the flying saucer is in the air stream. Projection 51 provides a pivotal axis around which the flying saucer rotates, when activated by an air stream from the tubes 26 or 26A.

Figure 4:
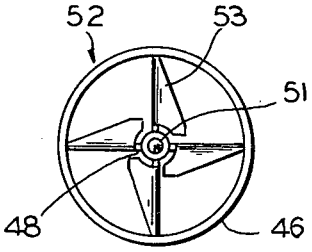

FIG. 4 shows opposing saucer 52 which is used to fight the flying saucer 17. The flying saucer 52 of FIG. 4, it should be noted, also has a circumferential section 46 and a hub section 48 with the upstanding pyramidal projection 51. However, the blades of flying saucer 52, such as blade 53, are angled downward in the direction 90 degrees out of phase of the blades of flying saucer 17. Therefore, flying saucer 52 rotates in a direction opposite to that of flying saucer 17, when air is directed at the flying saucers. If the opposing flying saucers are rotated in the same direction, then when they collide with each other, the rotation of both the flying saucers would be abrogated and both of the opposing flying saucers would fall from the ceiling.

Figure 8:
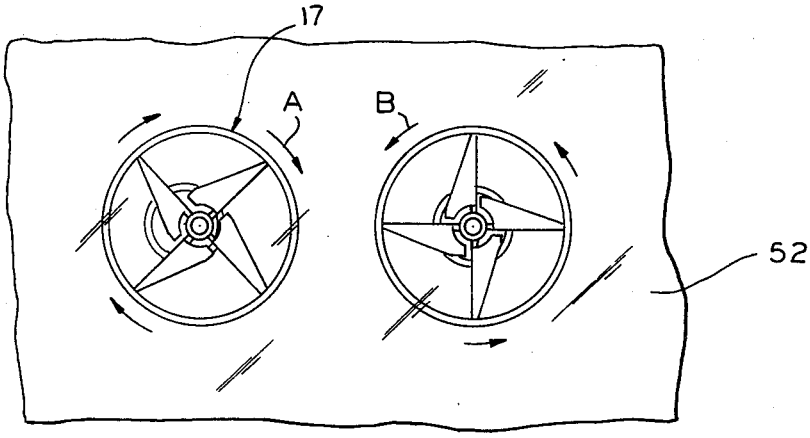
FIG. 8 is a plan view showing the rotation of two opposing flying saucers against the transparent ceiling of the game unit, when an air stream is directed towards each one.

FIG. 8 best shows the counter rotating flying saucers 17 and 52. The rotation is indicated by the arrows, such as arrows A and B, respectively.

Figure 2:
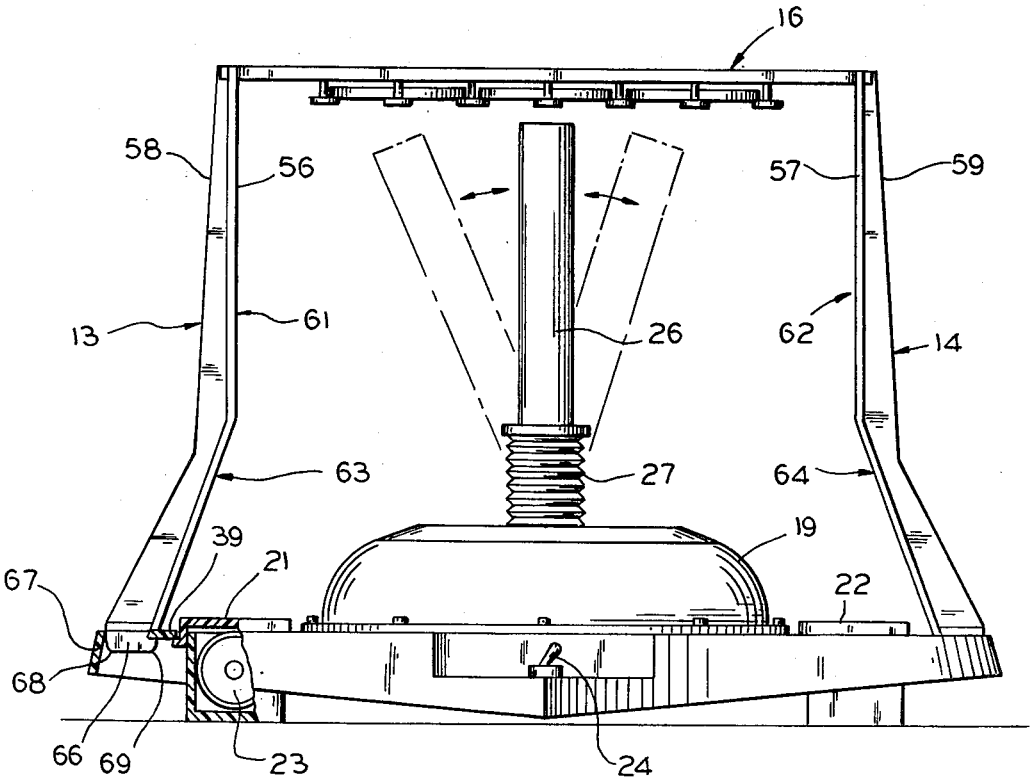
FIG. 2 is a front view of the inventive game.
Figure 5:
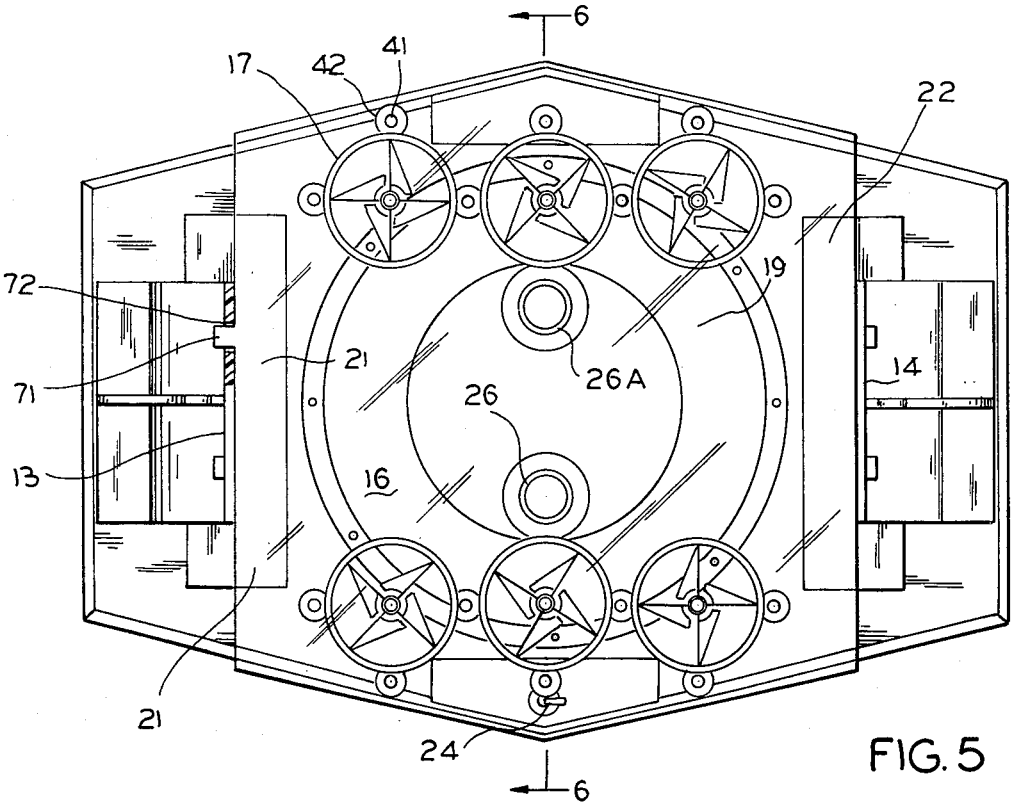
FIG. 5 is a plan view of the game unit.

One of the features of the fighting U.F.O. game is the ease with which it is assembled from its "knocked down" condition. More particularly, as seen in FIG. 2, for example, the walls 13 and 14 are designed to clip to the base unit 12, and the transparent ceiling unit 16 is designed to clip directly to the walls. More particularly, the walls 13 and 14 comprise oppositely disposed spaced apart parallel flat sections 56 and 57. The flat sections 56 and 57 are reinforced by the flanges 58 and 59 which respectively extend down the centers of the walls 13 and 14.

The top sections 61 and 62 of the walls 13 and 14, respectively, are parallel to each other. The bottom portions 63 and 64 of the walls 13 and 14, respectively, extend away from each other.

Means are provided for snapping the walls to the base unit. More particularly, as seen in FIG. 2, flange 58 of wall 13 extends to form a hook section 66 beyond the bottom of the wall unit. The hook section 66 extends into an aperture 67 on floor 39. The outer end 68 of the hook section 66 is arcuate while the inner end 69 abuts the bottom of the floor 39, when the wall unit is snapped into place standing erect and holding the ceiling unit 16. The transparent ceiling unit 16 includes a pair of protruding nipples, such as nipple 71, which extends through an aperture 72 near the top of the flat section 61 of wall 13 to receive the ceiling unit to the walls.

In assembling, the wall units are first fit into the base 12 of the game unit and then the ceiling unit 16 is positioned with its nipples, such as nipple 71, extending through the apertures in the wall sections. The ceiling unit 16 is thus held firmly in place supported by the oppositely disposed walls 13 and 14 and actually aids in supporting the walls.

Figure 7:
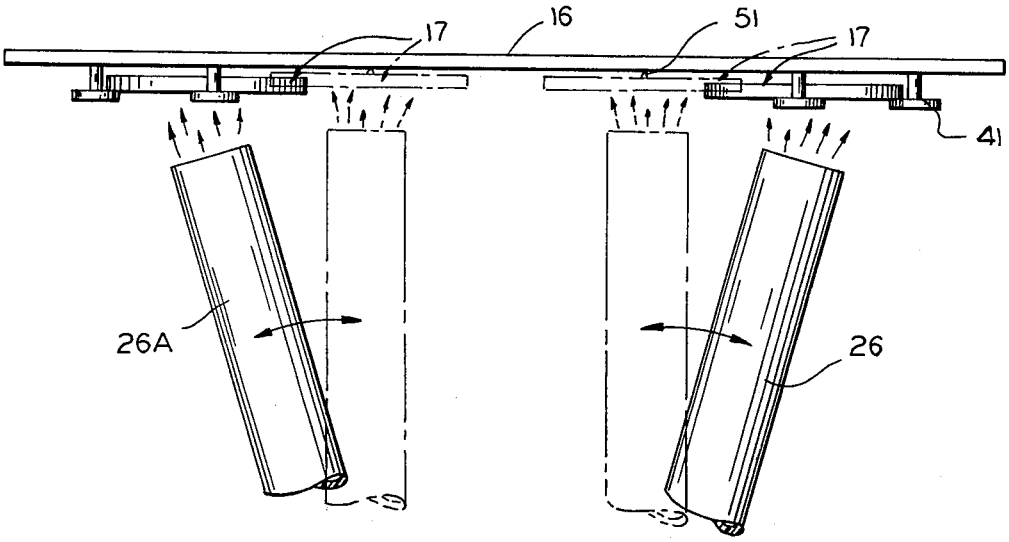
FIG. 7 is an action view showing the manipulations of the tube used in controlling the flying saucers.

In operation switch 24 is operated to extend battery power to motor 28 turning the fan units 31 to send air through dome funnel portions 34 and 36 and into the tubes 26 and 26A. The tubes 26 and 26A are readily mounted to funnels 34 and 36 using accordian pleated sections 27 and 27A. The tubes are positioned by the "players", as shown in FIG. 7 by rotating around the movable pleated accordian section 27, 27A.

To remove the flying saucers from the landing or at rest positions among the landing pins or pegs, such as peg 41, and to attempt to force the opponents flying saucers from the range of the opponents tube, each player directs an air stream at his own flying saucer. This causes the flying saucer to be lifted from the supporting landing pegs and to rotate around pyramidal projection 51 abutting the ceiling unit 16. The tubes have a remarkable degree of dexterity and the opposing players have the freedom of moving the versatile tubes to maneuver their respective flying saucers in attempting to "shoot down" the opponents flying saucer by timely collisions between the opposing flying saucers.

While the principles of the invention have been described above in connection with specific apparatus and applications it is to be understood that this description is made by way of example only and not as a limitation on the scope of the invention.

We claim:

1. A game device featuring opposing players manipulating flying saucers and attempting to "shoot down" the opposing flying saucers, said game device comprising:

a base unit;

air compressor means for generating air streams within said base unit;

air tube means for directing said air stream;

flying saucer means, said flying saucer means rendered mobile by said air stream;

ceiling structure for limiting the upward movement of said flying saucer means; and means for moving said air tube means to control the direction of movement of said flying saucers.

2. The game device of claim 1 wherein said air tube means comprises a pair of air tubes, and each of said pair of air tubes including an accordian pleated section being separably movably about said accordian pleated section for directing the individual air streams.

3. An improved game device featuring opposing players, each of said players manipulating flying saucers in attempting to "shoot down" the opposing flying saucers, said game device comprising a base unit;

air compressor means for generating air streams within said base unit;

said improvement characterized in this that:

movable air tube means for selectively directing said air stream are provided, opposing flying saucer means rotated in opposite directions responsive to said air stream, and ceiling means for containing said flying saucer means and providing a base upon which said flying saucer means can rotate and be directed to collide with the flying saucer means until one of the opposing flying saucer means is forced from the limits of the directed air stream and is thereby "shot down".

4. A game device featuring opposing players manipulating flying saucers and attempting to "shoot down" the opposing flying saucers, said game comprising:

a base unit;

air compressor means for generating air streams within said base unit;

air tube means for directing said air stream;

flying saucer means, said flying saucer means rendered mobile by said air stream;

ceiling structure for limiting the upward movement of said flying saucer means;

said flying saucer means includes pyramidal projections extending upward to abut said ceiling structure when said flying saucer means is in said air stream;

means for moving said air tube means to control a direction of movement of said flying saucers; and means for causing said flying saucers to rotate about said pyramidal projections.

5. The game device of claim 4 wherein opposing flying saucers are provided, and means for causing said opposing flying saucers to rotate in opposite directions responsive to the air streams.

6. The game device of claim 4 wherein said ceiling structure is transparent.

7. A game device featuring opposing players manipulating flying saucers and attempting to "shoot down" the opposing flying saucers, said game device comprising:

a base unit;

air compressor meansfor generating air streams within said base unit;

air tube means for directing said air stream;

flying saucer means, said flying saucer means rendered mobile by said air stream;

ceiling structure for limiting the upward movement of said flying saucer means;

means for moving said air tube means to control the direction of movement of said flying saucers; and wherein landing means are provided for retaining said flying saucer means juxtaposed to said ceiling structure in the absence of said air stream.

8. The game device of claim 7 wherein said landing means comprises peg means attached to said ceiling means and extending downward therefrom, said peg means each including a main cylindrical body, head means having a larger diameter than said cylindrical body spaced apart from said ceiling means by said cylindrical body, and said head means serving as a resting place for said flying saucer means in the absence of said air stream.

9. A game device featuring opposing players manipulating flying saucers and attempting to "shoot down" the opposing flying saucers, said game device comprising:

a base unit;

air compressor means for generating air streams within said base unit;

air tube means for directing said air stream;

flying saucer means, said flying saucer means rendered mobile by said air stream;

means for moving said air tube to control the direction of movement of said flying saucers;

said flying saucer means comprising a circular peripheral section, hub means centrally located within said circular peripheral section, blade means extending between said hub means and said circular peripheral section, said blade means comprising a rod connecting the circular peripheral section and the hub means, the blade means further comprising a leading edge angled from the peripheral section to the hub means, and said blade means being at an acute angle to the horizontal.

10. The game device of claim 9 and opposing flying saucer means, the angle to the horizontal of the blade means of the opposing flying saucer means being 90 degrees apart, whereby said opposing flying saucers rotate in opposite directions when in the air streams.

* * * * *